United States Patent [19]

Ota et al.

[11] Patent Number: 4,467,159

[45] Date of Patent: Aug. 21, 1984

[54] SELECTIVELY LOCKABLE PUSH SWITCH

[75] Inventors: Yoshihiro Ota, Ichinomiya; Mitsuo Kobayashi, Gifu, both of Japan

[73] Assignee: Kabushiki Kaisha Tokai Rika Denki Seisakusho, Aichi, Japan

[21] Appl. No.: 424,562

[22] Filed: Sep. 27, 1982

[30] Foreign Application Priority Data

Oct. 19, 1981 [JP] Japan ..... 56-156215[U]

[51] Int. Cl.[3] ..... H01H 13/64

[52] U.S. Cl. ..... 200/153 J; 200/291; 200/16 R

[58] Field of Search ..... 200/153 J, 260, 252, 200/16 C, 16 R, 291

[56] References Cited

U.S. PATENT DOCUMENTS

| | | | |
|---|---|---|---|
| 3,629,526 | 12/1971 | Lewis | 200/16 C |
| 3,639,714 | 2/1972 | Fujimoto | 200/153 J |
| 3,821,534 | 6/1974 | Mehner et al. | 200/153 J X |
| 3,982,090 | 9/1976 | Lewis | 200/291 |
| 4,112,277 | 9/1978 | Kleeb | 200/153 J |
| 4,152,565 | 5/1979 | Rose | 200/291 |
| 4,254,315 | 3/1981 | Stevens | 200/153 J |

FOREIGN PATENT DOCUMENTS

| | | | |
|---|---|---|---|
| 2893003 | 4/1980 | Fed. Rep. of Germany | 200/153 J |
| 2853810 | 4/1980 | Fed. Rep. of Germany | 200/291 |
| 1367668 | 6/1963 | France | 200/153 J |
| 7337657 | 5/1975 | France | 200/153 J |
| 1336016 | 11/1973 | United Kingdom | 200/153 J |
| 1494334 | 12/1977 | United Kingdom | 200/153 J |

*Primary Examiner*—Stephen Marcus
*Assistant Examiner*—Ernest G. Cusick
*Attorney, Agent, or Firm*—Jackson, Jones & Price

[57] ABSTRACT

A selectively lockable push switch adapted to be turned on in a multistage manner, including a casing, a holder movable together with a knob projecting out of a through-opening of the casing, a compression spring for urging the holder upwardly, an uneven portion formed on either one of the holder and the casing, a coiled spring provided with a lever member having an engageable portion formed at its one end such that the engageable portion is moved along a grooved displacement passage formed on the uneven portion in response to upward and downward displacement of the holder, and switch means selectively turned on in the multistage manner in response to displacement of the holder.

10 Claims, 9 Drawing Figures

SELECTIVELY LOCKABLE PUSH SWITCH

BACKGROUND OF THE INVENTION

The present invention generally relates to an electrical switch and more particularly, to a selectively lockable push switch provided with an actuator having a free or unlocked position and a plurality of locking positions, in which the actuator can be selectively and directly displaced from the free position to any one of the plurality of the locking positions for its locking thereat.

Although there have been conventionally proposed various kinds of lockable push switches adapted to be turned on in a multistage manner, they are generally accompanied by such disadvantages that constructions thereof are rather complicated, not being particularly efficient in use, with a consequent rise in the manufacturing cost, etc.

SUMMARY OF THE INVENTION

Accordingly, an essential object of the present invention is to provide an improved selectively lockable push switch which is remarkably excellent in operational efficiency, with substantial elimination of disadvantages inherent in conventional selectively lockable push switches of this kind.

Another important object of the present invention is to provide an improved selectively lockable push switch which is simple in structure, highly reliable in actual use and suitable for mass production at low cost.

In accomplishing these and other objects according to one preferred embodiment of the present invention, there is provided an improved selectively lockable push switch adapted to be selectively turned on in a multistage manner, comprising:

a casing;

a holder accommodated in said casing so as to be movable upwardly and downwardly together with a knob projecting out of a through-opening of said casing;

a compression spring for urging said holder upwardly;

an uneven portion formed on either one of a side face of said holder and an inner surface of said casing with said side face of said holder and the inner surface of said casing confronting each other;

a coiled spring provided with a lever member having an engageable portion formed at one end thereof, which is supported on the other one of said side face of said holder and the inner surface of said casing such that said lever member is urged in one direction;

said uneven portion being formed with a grooved displacement passage for said engageable portion such that said engageable portion is moved along said grooved displacement passage in response to downward and upward displacement of said holder through manipulation of said knob for downward depression thereof and through upward urging of said compression spring;

said grooved displacement passage having a free position whereat said engageable portion is disposed when said holder is in a free state, and having a plurality of locking positions at any one of which said engageable portion is disposed so as to lock said holder when said holder has been displaced to any one of a plurality of predetermined positions, whereby said holder is locked at the any one of the plurality of the predetermined positions;

said grooved displacement passage being arranged such that said engageable member can be selectively displaced from the free position to the any one of the plurality of the locking positions directly; and switch means having a plurality of fixed contacts and a movable contact which is brought into contact with corresponding one of the plurality of said fixed contacts in response to displacement of said holder to the any one of the plurality of the predetermined positions such that said selectively lockable push switch is selectively turned on in the multistage manner at the any one of the plurality of said predetermined positions of said holder.

In accordance with the present invention, the holder can be locked highly efficiently at any one of the plurality of the locking positions whereat the selectively lockable push switch is selectively turned on in the multistage manner.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that the like parts are designated by like reference numerals throughout several views of the accompanying drawings.

DETAILED DESCRIPTION OF THE INVENTION

Figure 1:
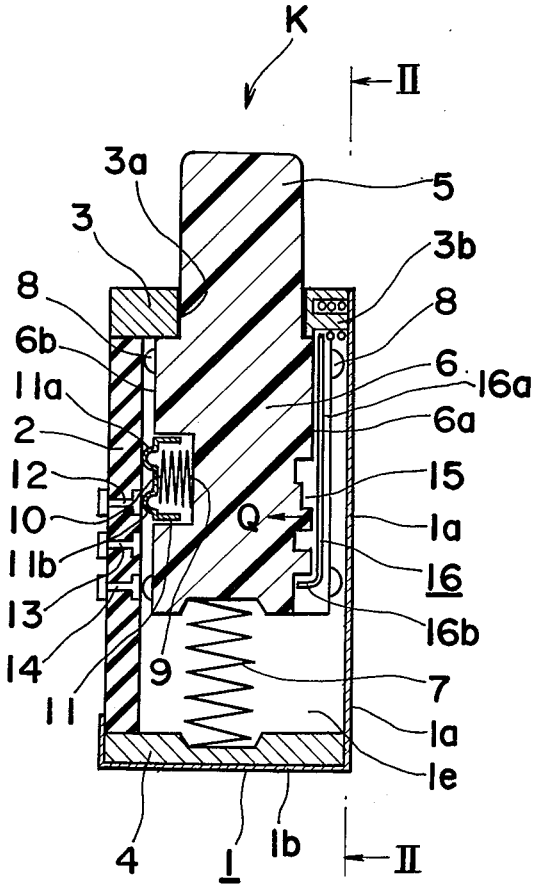
FIG. 1 is a cross-sectional view of a selectively lockable push switch according to the present invention.
Figure 2:
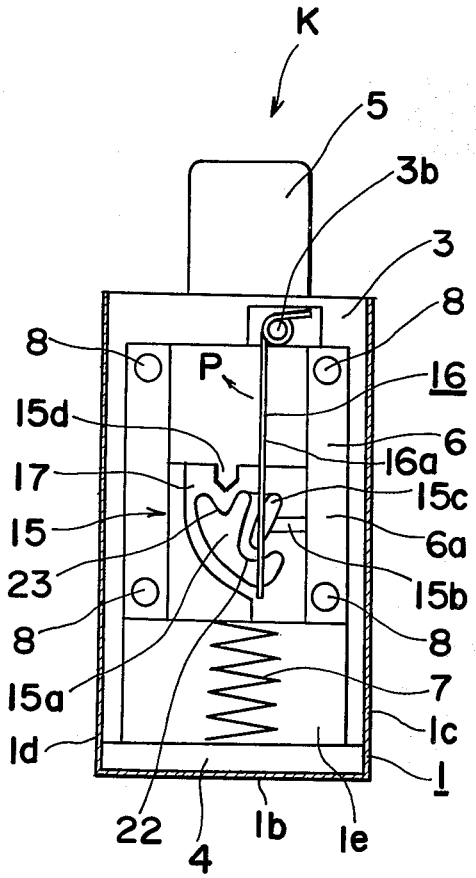
FIG. 2 is a cross-sectional view taken along the line II—II in FIG. 1.
Figure 3:
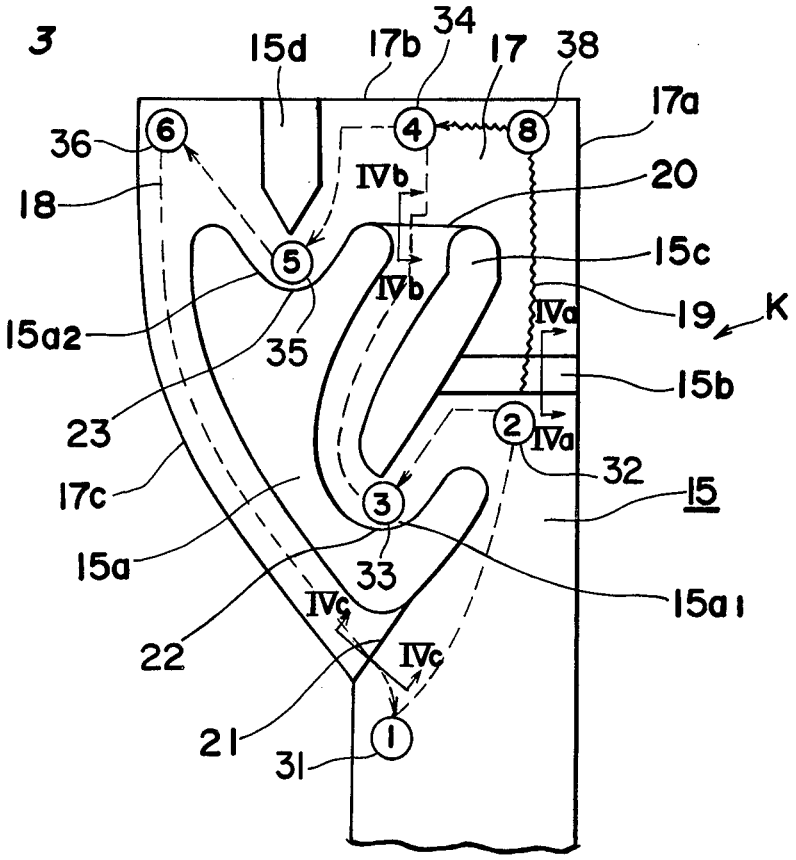
FIG. 3 is a view showing, on an enlarged scale, an uneven portion of a holder employed in the selectively lockable push switch of FIG. 1, FIGS. 4(*a*), 4(*b*) and 4(*c*) are cross-sectional views taken along the lines IV*a*—IV*a*, IV*b*—IV*b* and IV*c*—IV*c* in FIG. 3, respectively.

Referring now to the drawings, there is shown in FIGS. 1 to 3, a selectively lockable push switch K according to one preferred embodiment of the present invention.

The selectively lockable push switch K is adapted to be selectively turned on in a multistage manner and includes an elongated switch casing 1 having a rectangular cross-section, an insulator 2, an upper bushing 3, a lower bushing 4, an elongated contact holder 6 made, for example, of an insulating material such as plastics or the like and integrally formed with a knob 5 and a compression spring 7.

It is to be noted here that all directional indications such as "top", "rear", "right", etc. relate to the illustration in FIGS. 2 and 3, hereinbelow.

The switch casing includes a front side wall 1*a*, a bottom wall 1*b*, a right side wall 1*c* and a left side wall 1*d*. The insulator 2, upper bushing 3 and lower bushing 4 are, respectively, secured to a rear side face, a top face, and an inner surface of the bottom wall 1*b* of the switch casing 1, so that a hollow portion 1*e* is formed in the switch casing 1. The switch casing 1 has a box-like configuration and the upper bushing 3 is formed with a through-opening 3*a* communicating with the hollow portion 1*e*. The contact holder 6 integrally formed with the knob 5 having a cross section smaller, in area, than that of the contact holder 6 is accommodated in the hollow portion 1*e* such that the knob 5 projects out of the through-opening 3*a*. It is to be noted that the contact holder 6 acts as an actuator for the selectively lockable push switch K. The compression spring 7 is provided between the lower bushing 4 and a bottom face of the contact holder 6 in the hollow portion 1*e* so as to urge the contact holder 6 upwardly such that the knob 5 slidably projects out of the through-opening 3*a* of the upper bushing 3.

More specifically, the contact holder 6 is substantially formed into a shape of a rectangular parallelepiped and includes a front side face 6*a* and a rear side face 6*b*. Four guide balls 8 are provided at upper right, lower right, upper left and lower left portions of the front side face 6*a* so as to be brought into sliding contact with an inner surface of the front side wall 1*a*. Likewise, four guide balls 8 are provided at upper right, lower right, upper left and lower left portions of the rear side face 6*b* so as to be brought into sliding contact with an inner surface of the insulator 2. Meanwhile, a recess portion 9 is formed approximately at a central portion of the rear side face 6*b*. A movable contact 11 of a substantially U-shaped configuration is fitted into the recess portion 9 and a compression spring 10 is interposed between the recess portion 9 and the movable contact 11 such that the movable contact 11 is urged towards the inner surface of the insulator 2, whereby the movable contact 11 is brought into sliding contact with the inner surface of the insulator 2. The movable contact 11 includes a first movable contact 11*a* and a second movable contact 11*b* which are projections formed at an upper portion and a lower portion of the movable contact 11. On the other hand, three through-holes are formed on the insulator 2 at a predetermined interval therebetween in a vertical direction of the insulator 2 such that a first fixed contact 12, a second fixed contact 13 and a third fixed contact 14 are, respectively, fitted into the three through-holes flush with the inner surface of the insulator 2.

When the contact holder 6 is at a free or unlocked position (referred to as "a free position" hereinbelow) whereat the contact holder 6 is disposed at an upper limit position thereof by an upward urging force of the compression spring 7, the selectively lockable push switch K is in the "OFF" state with the second movable contact 11*b* being in contact with the first fixed contact 12. When the knob 5 is depressed by one step downwardly from the free position of the contact holder 6, a first step switch S1 (not shown) is turned on with the first movable contact 11*a* and the second movable contact 11*b* being in contact with the first fixed contact 12 and the second fixed contact 13, respectively (a first step position). When the knob 5 is further depressed by another step downwardly, a second step switch S2 (not shown) is turned on with the first movable contact 11*a* and the second movable contact 11*b* being in contact with the second fixed contact 13 and the third fixed contact 14, respectively (a second step position).

The selectively lockable push switch K further includes an uneven portion or camming face 15 formed at a lower central portion of the front side face 6*a* and a follower lever in the form of a coiled spring 16 associated with the uneven portion 15 which are arranged to lock the knob 5 and the contact holder 6 at the free position, first level or step position and second level or step position. These level positions can provide electrical states of conductivity for the switch K.

Hereinbelow, the uneven portion 15 and the coiled spring 16 will be described.

The coiled spring 16 is wound around a support rod portion 3*b* formed at a front portion of the upper bushing 3 and includes a lever member 16*a* extending downwardly into the uneven portion 15. The lever member 16*a* has an engageable portion 16*b* formed at one end thereof and bent rearwardly, which is slidably fitted into the uneven portion 15. The lever member 16*a* is urged in the direction indicated by the arrow Q in FIG. 1 and in the direction indicted by the arrow P in FIG. 2.

On the other hand, a central portion of the front side face 6*a* except for opposite side portions having the four guide balls 8 mounted thereon is recessed and further, the uneven portion 15 is formed on the lower part of the central portion of the front side face 6*a*.

As best shown in FIG. 3, the uneven portion 15 includes a recessed portion 17, a first projection 15*a*, a second projection 15*b*, a third projection 15*c* and a fourth projection 15*d* with only the recessed portion 17 being shown by hatching. The first projection 15*a*, second projection 15*b*, third projection 15*c* and fourth projection 15*d* are formed on the recessed portion 17. The recessed portion 17 has a substantially rectangular shape and includes a right side edge 17*a* extending vertically, an upper side edge 17*b* extending at right angles to the right side edge 17*a*, and a left side edge 17*c* curved obliquely and downwardly in a direction toward the right side edge 17*a*. The first projection 15*a* is formed at a left portion of the recessed portion 17 so as to extend in parallel with the left side edge 17*c* and includes a lower V-shaped portion 15*a*1 and an upper V-shaped portion 15*a*2 which are formed at a lower portion and an upper portion thereof, respectively and are directed upwardly. The third projection 15*c* extends obliquely and downwardly in a direction remote from the right side edge 17*a* so as to confront the lower V-shaped portion 15*a*1 such that the third projection 15*c* is spaced a predetermined distance from the lower V-shaped portion 15*a*1. Likewise, the fourth projection 15*d* extends downwardly so as to confront the upper V-shaped portion 15*a*2 such that the fourth projection 15*d* is spaced a predetermined distance from the upper V-shaped portion 15*a*2. The second projection 15*b* extends horizontally from the right side edge 17*a* so as to be connected with a vertically central portion of the third projection 15*c*. Accordingly, a first grooved displacement passage 18 for the engageable member 16*b* is formed around the first projection 15*a* so as to be enclosed by the second projection 15*b*, third projection 15*c*, fourth projection 15*d* and left side edge 17*c*. Furthermore, a second grooved branch passage 19 is formed between the third projection 15*c* and the right side edge 17*a* and between the third projection 15*c* and the upper side edge 17*b*.

More specifically, the displacement passage 18 includes a local point ①, drawing element 31 disposed below the lower V-shaped portion 15*a*1, a local point ②, drawing element 32 disposed below the second projection 15*b* and rightward of the third projection 15*c*, a local point ③, drawing element 33 disposed above the lower V-shaped portion 15a1 and below the third projection 15c, a local point ④, drawing element 34 disposed below the upper side edge 17b and rightward of the fourth projection 15d, a local point ⑤, drawing element 35 disposed above the upper V-shaped portion 15a2 and below the fourth projection 15d, and a local point ⑥, drawing element 36 disposed at a corner formed by the upper side edge 17b and left side edge 17c. The branch passage 19 includes the local points ② and ④ and a local point ⑧, drawing element 38 disposed at a corner formed by the right side edge 17a and upper side edge 17b. Therefore, the local point ① is disposed at the lowest position of the displacement passage 18 and the local points ④ and ⑥ are disposed at the highest position of the displacement passage 18 with the local point ⑧ being disposed at the same height as that of the local point ④. Namely, the displacement passage 18 is formed so as to take a circulated zigzag path extending counterclockwise in the sequence of the local points ①, ②, ③, ④, ⑤, ⑥ and ① as shown in broken lines in FIG. 3. The branch passage 19 is formed so as to extend upwardly in parallel with the right side edge 17a from the local point ② to the local point ⑧ and horizontally in parallel with the upper side edge 17b from the local point ⑧ to the local point ④ as shown in wavy lines in FIG. 3.

It should be noted here that the engageable portion 16b of the coiled spring 16 is disposed at the local point ① when the contact holder 16 is in the free state as described above.

Figures 4A, 4B, 4C:
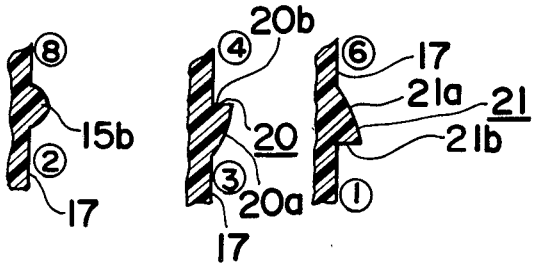

Meanwhile, the second projection 15b has a semicircular cross section as shown in FIG. 4(*a*) so as to allow the engageable portion 16b to proceed from the local point ② to the local point ⑧ or vice versa. Furthermore, a first protrusion 20 is formed between the local point ③ and the local point ④ and is inclined upwardly from the local point ③ to the local point ④ so as to have a right-angled triangular cross section as shown in FIG. 4(*b*). Thus, the first protrusion 20 has an inclined face 20a formed at the side of the local point ③, and a stopper face 20b extending at right angles to the surface of the recessed portion 17 at the side of the local point ④, so that the first protrusion 20 allows the engageable portion 16b to proceed from the local point ③ to the local point ④ but prevents the engageable portion 16b from proceeding reversely from the local point ④ to the local point ③. Likewise, a second protrusion 21 is formed between the local point ⑥ and the local point ① and is inclined upwardly from the local point ⑥ to the local point ① so as to have a right-angled triangular cross section as shown in FIG. 4(*c*). Thus, the second protrusion 21 has an inclined face 21a formed at the side of the local point ⑥, and a stopper face 21b extending at right angles to the surface of the recessed portion 17 at the side of the local point ①, so that the second protrusion 21 allows the engageable portion 16b to proceed from the local point ⑥ to the local point ① but prevents the engageable portion 16b from proceeding reversely from the local point 1 to the local point ⑥.

Accordingly, the displacement passage 18 extends from the local point ① upwardly to the local point ② along a lower right side edge of the first projection 15a. Then, the displacement passage 18 extends from the local point ② downwardly and leftward between the third projection 15c and the lower V-shaped portion 15a1 so as to reach the local point ③ and then, proceeds from the local point ③ upwardly between the third projection 15c and an upper right side edge of the first projection 15a so as to reach the local point ④. Then, the displacement passage 18 extends horizontally and leftward from the local point ④ to a position adjacent to an upper right side edge of the fourth projection 15d and further proceeds from the position downwardly between the fourth projection 15d and the upper V-shaped portion 15a2 so as to reach the local point ⑤. Subsequently, the displacement passage 18 extends from the local point ⑤ upwardly and leftward between the fourth projection 15d and the upper V-shaped portion 15a2 so as to reach the local point ⑥. Finally, the displacement passage 18 extends downwardly and rightward between the left side edge 17c and a left side edge of the first projection 15a so as to reach the local point ①. Thus, the displacement passage 18 includes two V-shaped passages, i.e., one V-shaped passage extending from the local point ② through the local point ③ to the local point ④ at a lower portion of the displacement passage 18 and the other V-shaped passage extending from the local point ④ through the local point ⑤ to the local point ⑥ at an upper portion of the displacement passage 18.

It should be noted that the local points ③ and ⑤ are arranged to act, respectively, as a first locking position 22 and a second locking position 23 each for the contact holder 6 to be described later.

Accordingly, it is so arranged that the displacement passage 18 extends downwardly and leftward so as to reach the first locking position 22 after proceeding upwardly from the local point ① to the local point ② and then, proceeds upwardly again to the local point ④, so that the displacement passage 18 extends from the local point ④ downwardly and leftward so as to reach the second locking position 23 and thus, finally returns to the local point ①, whereby the displacement passage 18 is circulated. Consequently, when the contact holder 6 is lowered, the engageable portion 16b of the coiled spring 16 is caused to proceed upwardly along the displacement passage 18. Since the lever member 16a is urged leftward as shown by the arrow P in FIG. 2, the engageable member 16b is caused to proceed leftward at the local points ② and ④. When the contact holder 6 is moved upwardly upon release of the knob 5 at the local points ② and ④, the engageable portion 16b is lowered along the displacement passage 18 so as to be stopped and held at the first locking position 22 and the second locking position 23, respectively.

Meanwhile, the branch passage 19 extends upwardly from the local point ② and crosses over the second projection 15b so as to reach the local point ⑧. Then, the branch passage 19 proceeds leftward from the local point ⑧ to the local point ④. It is so arranged that the engageable portion 16b is guided from the local point ① to the second locking position 23 directly by the branch passge 19 so as to skip the first locking position 22 of the displacement passage 18.

As can be understood from the foregoing, when the contact holder 6 is locked through engagement of the engageable portion 16b by the first locking position 22, the first movable contact 11a and the second movable contact 11b of the movable contact 11 are brought into contact with the first fixed contact 12 and the second fixed contact 13, respectively, so that the first step switch S1 is turned on. Furthermore, when the contact holder 6 is locked through engagement of the engageable portion 16b by the second locking position 23, the first movable contact 11*a* and the second movable contact 11*b* are, respectively, brought into contact with the second fixed contact 13 and the third fixed contact 14, so that the second step switch S2 is turned on.

Hereinbelow, operations of the selectively lockable push switch K having the above described constructions will be described.

When the contact holder 6 is in the free state wherein the knob 5 is not depressed downwardly, the contact holder 6 is urged upwardly by the compression spring 7 and thus, is disposed at its upper limit position with an upper end of the contact holder 6 being in contact with an inner surface of the upper bushing 3. Since, at this moment, the first movable contact 11*a* of the movable contact 11 is not brought into any one of the first fixed contact 12, second fixed contact 13 and third fixed contact 14, the selectively lockable push switch K is in the "OFF" state. Meanwhile, at this moment, the engageable portion 16*b* is disposed at the local point ① located at the lowest position of the displacement passage 18 and is urged in the direction indicated by the arrow P in FIG. 2, the engageable portion 16*b* is locked at the local point ① by the second protrusion 21.

When the knob 5 is depressed downwardly from the above described "OFF" state of the selectively lockable push switch K, the contact holder 6 is lowered against the upward urging force of the compression spring 7, so that the engageable portion 16*b* is slidably moved upwardly along the displacement passge 18. Then, when the engageable portion 16*b* reaches the local point ②, the engageable portion 16*b* is brought into contact with the second projection 15*b* and thus, a slight contact stress is applied to the knob 5. When an operator of the selectively lockable push switch K releases his hand from the knob 5 at this moment, the contact holder 6 is caused to proceed upwardly by the compression spring 7, so that the engageable portion 16*b* is moved in the direction indicated by the arrow P in FIG. 2, i.e., leftward and then, reaches the local point ③ (first locking position 22), whereby the contact holder 6 is locked and the first step switch S1 is turned on at the first locking position 22.

When the knob 5 is further depressed downwardly from the first locking position 22, the contact holder 6 is lowered, so that the engageable portion 16*b* is slidably moved upwardly from the local point ③ to the local point ④. The engageable portion 16*b* is moved leftward from the local point ④ and then, is brought into contact with the fourth projection 15*d*, so that it becomes impossible to move the engageable portion 16*b* further leftward. When the operator releases his hand from the knob 5 at this moment, the contact holder 6 is raised by the compression spring 7 so as to reach the local point ⑤ (second locking position 23), whereby the contact holder 6 is locked and the second step switch S2 is turned on at the second locking position 23.

When the knob 5 is depressed downwardly from the second locking position 23, the contact holder 6 is lowered, so that the engageable portion 16*b* is slidably moved upwardly and leftward from the local point ⑤ to the local point ⑥. Since the engageable portion 16*b* is brought into contact with the upper side edge 17*b* and the left side edge 17*c* at the local point ⑥, a considerable contact stress is applied to the knob 5. When the operator releases his hand from the knob 5 at this moment so as to set the knob 5 free, the contact holder 6 is moved upwardly by the compression spring 7, so that the engageable portion 16*b* is returned from the local point ⑥ to the local point ① and thus, the contact holder 6 is in the initial free state wherein the selectively lockable push switch K is in the "OFF" state.

Moreover, in the case where the knob 5 is further depressed downwardly against the slight contact stress produced through contact of the engageable portion 16*b* by the second projection 15*b* at the local point ②, the engageable portion 16*b* is moved upwardly from the local point ② to the local point ⑧ and then, is moved leftward from the local point ⑧ to the local point ④. When the operator releases his hand from the knob 5 at this moment, the contact holder 6 is moved upwardly by the compression spring 7, so that the engageable portion 16*b* is caused to proceed from the local point ④ to the local point ⑤ (second locking position 23) and thus, the contact holder 6 is locked at the second locking position 23, whereby it becomes possible to displace the contact holder 6 from the free position to the second locking position 23 directly.

Accordingly, in the selectively lockable push switch K, the contact holder 6 can be selectively displaced from the free position to any one of the first locking position 22 and the second locking position 23.

Figure 5:
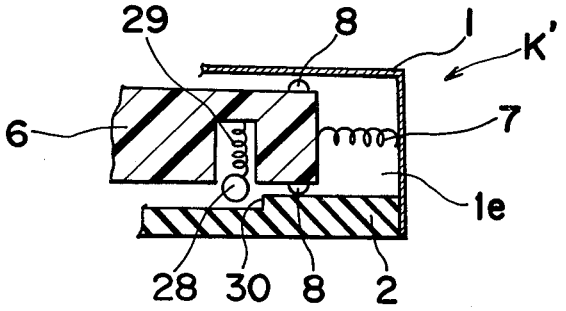
FIG. 5 is a cross-sectional view, particularly showing a modification of a second projecton of the uneven portion of FIG. 3.

Meanwhile, since the selectively lockable push switch K is not limited, in constructions, to the above described embodiment, the second projection 15*b* for applying the slight contact stress to the knob 5 at the local point ② can be replaced by an arrangement including a contact piece or pressure member such as a spherical ball 28, a compression spring 29 secured to the rear face of the contact holder 6 and a projection 30 formed on the inner surface of the insulator 2 of a selectively lockable push switch K' according to a first modification of the selectively lockable push switch K as shown in FIG. 5. In the modified selectively lockable push switch K', the contact piece 28 attached to one end of the compression spring 29 is urged toward the inner surface of the insulator 2. Thus, it is so arranged that, when the knob 5 is depressed downwardly such that engageable portion 16*b* reaches the local point ②, the contact piece 28 is brought into contact with the projection 30 and thus, the slight contact stress is applied to the knob 5. Since other constructions of the selectively lockable push switch K' is similar to those of the selectively lockable push switch K, description thereof is abbreviated for brevity.

Figure 6:
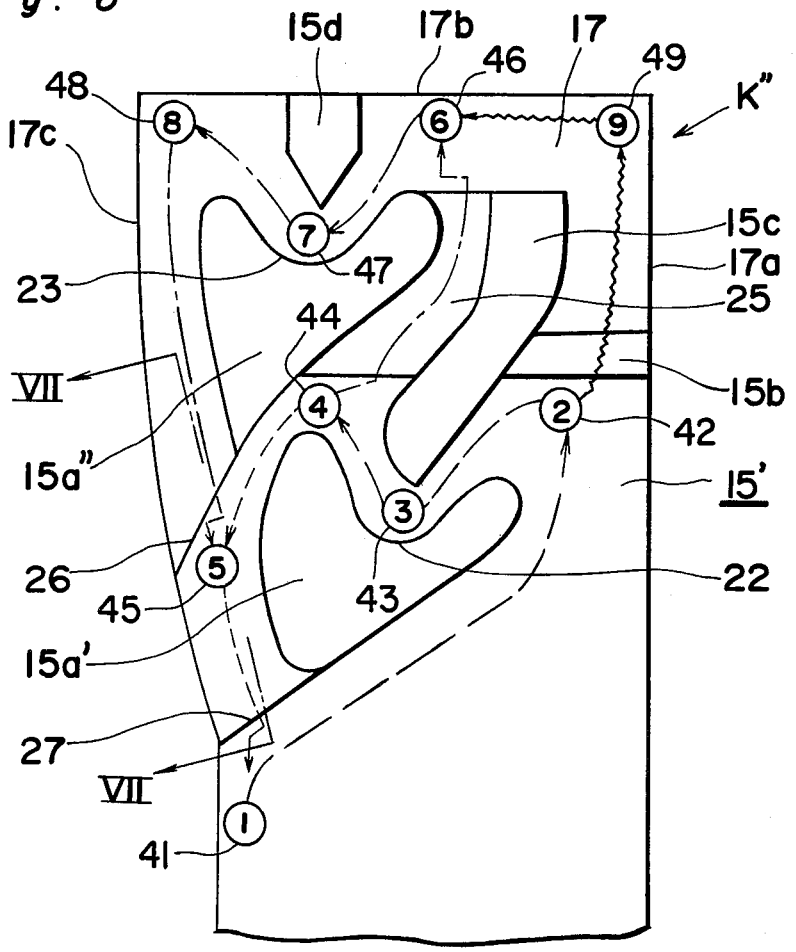
FIG. 6 is a view similar to FIG. 3, particularly showing a modification thereof.
Figure 7:
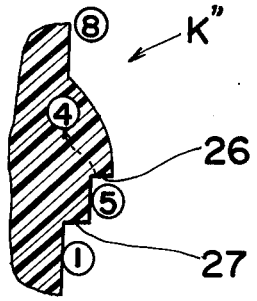
FIG. 7 is a cross-sectional view taken along the line VII—VII in FIG. 6.

Furthermore, the uneven portion 15 shown in FIG. 3 can be modified to an uneven portion 15' of a selectively lockable push switch K" according to a second modification of the selectively lockable push switch K such that the contact holder 6 can be displaced from the first locking position 22 to the free position directly as shown in FIG. 6. Namely, in the modified selectively lockable push switch K", the first projection 15*a* of the selectively lockable push switch K is divided into a first projection 15*a'* and a fifth projection 15*a"*, and the grooved passage between the third projection 15*c* and the upper right portion of the first projection 15*a* of the selectively lockable push switch K is projected so as to form a projection 25 between the third projection 15*c* and the fifth projection 15*a"*. However, it is to be noted that the projection 25 is lower, in level from the surface of the recessed portion 17, than the third projection 15*c* or the fifth projection 15*a"*. Meanwhile, a third protrusion 26 and a fourth protrusion 27 shown in FIG. 7 are formed on the recessed portion 17 between the left side edge 17*c* and the fifth projection 15*a"* and between the left side edge 17*c* and the first projection 15*a'*, respectively. Since other constructions of the selectively lockable push switch K" are similar to those of the selectively lockable push switch K, description thereof is abbreviated for brevity.

In the selectively lockable push switch K", when the knob 5 is set free, the engageable portion 16*b* is disposed at the local point ①, drawing element 41. When the knob 5 is depressed downwardly from the free state of the knob 5, the engageable portion 16*b* is caused to reach the local point ②, drawing element 42 so that the slight contact stress is applied to the knob 5 through contact of the engageable portion 16*b* by the second projection 15*b*. When the operator releases his hand from the knob 5 at this moment, the engageable portion 16*b* is caused to reach the local point ③ drawing element 43 (first locking position 22), so that the contact holder 6 is locked and the first step switch S1 is turned on at the first locking position 22.

When the knob 5 is further depressed downwardly from the first locking position 22, the engageable portion 16*b* is brought into contact with the projection 25 at a local point ④, drawing element 44 so that a slight contact stress is applied to the knob 5. Subsequently, when the operator releases his hand from the knob 5 so as to set the knob 5 free, the engageable portion 16*b* is slidably moved from the local point ④ through a local point ⑤, drawing element 45 to the local point ①, so that the contact holder 6 is held in the initial free state. Accordingly, the contact holder 6 can be displaced along a third passage from the first locking position 22 to the free position directly without passing through the second locking position 23.

In the case where the knob 5 is further depressed downwardly against the slight contact stress produced through contact of the engageable portion 16*b* by the projection 25 at the local point ④, the engageable portion 16*b* is moved upwardly from the local point ④ to a local point ⑥, drawing element 46. When the operator releases his hand from the knob 5 at this moment, the engageable portion 16*b* is caused to proceed to a local point ⑦, drawing element 47 (second locking position 23), the contact holder 6 is locked and the second step switch S2 is turned on at the second locking position 23. Thus, the contact holder 6 can be also displaced from the first locking position 22 to the second locking position 23.

Meanwhile, in the case where the knob 5 is further depressed downwardly against the slight contact stress produced through contact of the engageable portion 16*b* by the second projection 15*b* at the local point ②, the engageable portion 16*b* is moved upwardly from the local point ② to a local point ⑨, drawing element 49 and then, moved leftward from the local point ⑨ to the local point ⑥. When the operator releases his hand from the knob 5 at this moment, the engageable portion 16*b* is caused to reach the local point ⑦ (second locking position 23), so that the contact holder 6 is locked and the second step switch S2 is turned on at the second locking position 23. Therefore, the contact holder 6 can be directly displaced from the free position to the second locking position 23. When the knob 5 is depressed downwardly from the second locking position 23, the engageable portion 16*b* is moved upwardly from the local point ⑦ to the local point ⑧, drawing element 48. Subsequently, when the operator releases his hand from the knob 5 at this moment, the engageable portion 16*b* is returned from the local point ⑧ through the local point ⑤ to the local point ①.

As can be seen from the description given so far, in the selectively lockable push switch K", the contact holder 6 can be selectively and directly displaced from the free position for turning off the selectively lockable push switch K" to any one of the first locking position 22 for turning on the first step switch S1 and the second locking position 23 for turning on the second step switch S2, and the locking of the contact holder 6 at the any one of the first locking position 22 and the second locking position 23 can be cancelled such that the contact holder 6 is directly displaced to the free position from the any one of the first locking position 22 and the second locking position 23.

As is clear from the foregoing description, in accordance with the present invention, by simply depressing the knob downwardly, the holder can be directly displaced from the free position to the any one of the plurality of the locking positions so as to turn on the selectively lockable push switch in the multistage manner highly efficiently. As can be appreciated by a person of average skill in the switching art, it is possible to design a switch consistent with the present invention that will permit the camming face to be positioned on the inner wall of the switch casing instead of the exterior wall of the actuator, and the follower lever can be positioned on the actuator wall. Thus the relative movment of the camming face and follower lever defines an operative movement of the pushbutton switch and not their specific positions.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A multilever pushbutton switch comprising:

a switch casing having an inner wall;

a pushbutton knob;

an actuator having an external wall and mounted in the switch casing for relative movement of their respective walls, the actuator being moved by movement of the pushbutton knob;

means for biasing the actuator towards one end of the switch casing;

a camming face recessed in one of the inner wall of the switch casing and the external wall of the actuator;

a follower lever mounted on the other wall, of the actuator and the switch casing, which does not support the camming face, wherein the relative movement of the camming face and follower lever defines an operative movement of the pushbutton knob, to provide at least an off position, a first level on position and a second level on position;

means for biasing the follower lever against the camming face; and contact terminals mounted within the switch casing for providing an electrical state of conductivity relative to the first level position and second level position, the camming face defining a first passage for the follower lever to sequentially provide, from an initial off position, a first level switch position and a second level switch position and a second passage for the follower lever defining only a second level switch position, the camming face including a projection mounted across the second passage to provide a perceptible resistance to passage of the follower lever while still permitting passage directly to the second level switch position upon continued movement of the pushbutton knob whereby an operator upon sensing the projection resistance can selectively permit the follower lever to move along the first passage by the release of the pushbutton knob to assume the first level position, or by continuing to press the pushbutton knob, the operator can force the switch to directly pass to the second level position in a single activation of the pushbutton knob.

2. The invention of claim 1 wherein the actuator and the pushbutton knob are integrally formed.

3. The invention of claim 1 wherein the means for biasing the actuator is a compression spring.

4. The invention of claim 1 wherein the camming face defines a third passage for the follower lever to travel directly from the first level switch position to the off position.

5. The invention of claim 1 wherein the camming face is recessed in the external wall of the actuator and the follower lever is mounted on the internal wall of the switch casing.

6. The invention of claim 1 wherein the projection has a semicircular cross-section.

7. A multilevel pushbutton switch comprising:

a switch casing having an inner wall;

an actuator having an external wall and mounted in the switch casing for relative movement of their respective walls, the actuator includes a pushbutton knob extending through the switch casing such that it is moved by movement of the pushbutton knob;

spring means for biasing the actuator towards one end of the switch casing;

a camming face recessed in one of the inner wall of the switch casing and the external wall of the actuator;

a follower lever mounted on the other wall, of the actuator and the switch casing, which does not support the camming face, wherein the relative movement of the camming face and follower lever defines an operative movement of the pushbutton knob, to provide at least an off position, a first level on position first level position and a second level on position;

means for biasing the follower lever against the camming face; and contact terminals mounted within the switch casing for providing an electrical state of conductivity relative to the first level position and second level position, the camming face defining a first passage for the follower lever to sequentially provide, from an initial off position, a first level switch position and a second level switch position, a second passage for the follower lever defining only a second level switch position, the camming face including a projection mounted across the second passage to provide a perceptible resistance to passage of the follower lever while still permitting passage directly to the second level switch position upon continued movement of the pushbutton knob whereby an operator upon sensing the projection resistance can selectively permit the follower lever to move along the first passage by the release of the pushbutton knob to assume the first level position, or by continuing to press the pushbutton knob, the operator can force the switch to directly pass to the second level position in a single activation of the pushbutton knob and a third passage for the follower lever to travel directly from the first level switch position to the off position.

8. The invention of claim 7 wherein the follower lever is a pivotally mounted spring member.

9. The invention of claim 7 wherein the camming face is recessed in the external wall of the actuator and the follower lever is mounted on the internal wall of the switch casing.

10. The invention of claim 7 wherein the projection has a semicircular cross-section.

* * * * *